United States Patent [19]

Matsudo et al.

[11] 4,252,866

[45] Feb. 24, 1981

[54] DUAL LAYER-COATED ELECTRO-GALVANIZED STEEL SHEET FOR COATING WITH EXCELLENT BARE CORROSION RESISTANCE, CORROSION RESISTANCE AFTER COATING AND FORMABILITY

[75] Inventors: Kazuo Matsudo; Takeshi Adaniya; Masaru Ohmura; Masahiro Shoji, all of Fukuyama; Tsutomu Watanabe, Yokosuka, all of Japan

[73] Assignee: Nippon Kokan Kabushiki Kaisha, Tokyo, Japan

[21] Appl. No.: 87,107

[22] Filed: Oct. 22, 1979

[30] Foreign Application Priority Data

Nov. 22, 1978 [JP] Japan ..... 53-143289

[51] Int. Cl.[3] ..... B32B 15/18; B32B 15/00; C25D 5/10

[52] U.S. Cl. ..... 428/659; 75/178 R; 148/12 D; 204/35 R; 204/40; 204/43 Z; 427/406; 427/383.9; 428/926; 428/935

[58] Field of Search ..... 428/659, 926, 935; 148/12 D; 75/178 R; 204/35 R, 40, 432; 427/383 D, 406

[56] References Cited

U.S. PATENT DOCUMENTS

| | | | |
|---|---|---|---|
| 2,258,327 | 10/1941 | Kramer | 428/659 X |
| 3,278,331 | 10/1966 | Taylor et al. | 427/383 D |
| 3,986,843 | 10/1976 | Adaniya et al. | 204/35 R X |
| 4,064,320 | 12/1977 | Adaniya et al. | 428/659 X |
| 4,125,679 | 11/1978 | Mino et al. | 428/659 |
| 4,143,210 | 3/1979 | Hyner et al. | 428/659 X |
| 4,188,459 | 2/1980 | Hyner et al. | 428/659 X |
| 4,190,504 | 2/1980 | Usui | 204/35 R |

FOREIGN PATENT DOCUMENTS

| | | |
|---|---|---|
| 37-3107 | of 1962 | Japan . |
| 47-42343 | of 1972 | Japan . |
| 50-21940 | of 1975 | Japan . |
| 50-154126 | of 1975 | Japan . |
| 53-17534 | of 1978 | Japan . |

*Primary Examiner*—L. Dewayne Rutledge
*Assistant Examiner*—W. G. Saba
*Attorney, Agent, or Firm*—Frishauf, Holtz, Goodman & Woodward

[57] ABSTRACT

An electro-galvanized steel sheet for coating excellent in bare corrosion resistance, corrosion resistance after coating and formability, which comprises: a steel sheet; a first electro-galvanized layer, as a lower layer, in an amount of from 5 to 120 g/m$^2$ per side, formed on at least one surface of said steel sheet, said first electro-galvanized layer comprising either an electro-galvanized layer consisting essentially of zinc or a compound electro-galvanized layer consisting essentially of zinc, cobalt and at least one of chromium, indium and zirconium; and a second electro-galvanized layer, as an upper layer, in an amount of from 0.2 to 10 g/m$^2$ per side, formed on said first electro-galvanized layer, said second electro-galvanized layer consisting essentially of an alloy layer of zinc and from 1 to 60 wt. % iron. Said electro-galvanized steel sheet for coating is adapted to serve particularly for external, underside and closed structures of an automobile.

2 Claims, No Drawings

DUAL LAYER-COATED ELECTRO-GALVANIZED STEEL SHEET FOR COATING WITH EXCELLENT BARE CORROSION RESISTANCE, CORROSION RESISTANCE AFTER COATING AND FORMABILITY

REFERENCE TO PATENTS, APPLICATIONS AND PUBLICATIONS PERTINENT TO THE INVENTION

As far as we know, prior documents pertinent to the present invention are as follows:

(1) Japanese Patent Publication No. 3,107/62 dated May 31, 1962;

(2) Japanese Patent Provisional Publication No. 21,940/75 dated Mar. 8, 1975;

(3) Japanese Patent Provisional Publication No. 42,343/72 dated Dec. 15, 1972;

(4) Japanese Patent Provisional Publication No. 154,126/75 dated Dec. 11, 1975; and, (5) Japanese Patent Provisional Publication No. 17,534/78 dated Feb. 17, 1978.

The contents of the prior arts disclosed in the above-mentioned prior documents will be discussed under the "BACKGROUND OF THE INVENTION" described later.

FIELD OF THE INVENTION

The present invention relates to an electro-galvanized steel sheet for coating, excellent in bare corrosion resistance, corrosion resistance after coating and formability, which has a metal-plated layer comprising two layers on at least one surface of a steel sheet.

BACKGROUND OF THE INVENTION

Galvanized steel sheets are widely applied for various uses because of the excellent corrosion resistance imparted to a steel sheet under the effect of sacrificial protection (also referred to as cathodic protection) of the galvanized layer. An alloy-treated galvanized steel sheet, of which the entire galvanized layer is converted into a zinc-iron alloy layer (hereinafter referred to as a "Zn-Fe alloy layer") through a heating treatment after the galvanizing treatment is now attracting again the general attention in terms of the excellent corrosion resistance after coating (hereinafter referred to as the "post-coating corrosion resistance"), and uses thereof are expanding to cover those in automobiles and home electrical appliances. Especially, in addition to the high post-coating corrosion resistance, the excellent weldability and chipping resistance are creating an increasing demand for the alloy-treated galvanized steel sheet for use in external, underside and closed structures of automobiles for preventing damage caused by salt in automobiles used in cold districts where ice and snow on the road are melted with salt in winter.

There are known the following processes for manufacturing an alloy-treated galvanized steel sheet mentioned above:

(1) Processes based on hot-dip galvanizing:

(a) A process for manufacturing a hot-dip galvanized steel sheet having a Zn-Fe alloy galvanized layer, disclosed in Japanese Patent Publication No. 3,107/62 dated May 31, 1962, which comprises:

passing a steel sheet through a molten zinc bath in a non-oxidizing atmosphere; withdrawing said steel sheet from said bath while removing excess zinc from the surface of said steel sheet; and, heating said steel sheet, on the surface of which a galvanized layer has been formed, to alloy said galvanized layer and said steel sheet; thereby converting said galvanized layer into a Zn-Fe alloy layer;

said process being characterized by:

electrically heating said steel sheet from inside thereof to a temperature above the melting point of pure zinc, while said galvanized layer is still in the molten state; and, converting said galvanized layer into a uniform Zn-Fe (8–12%) alloy layer by holding said heating temperature during a period of time sufficient to allow iron molecules to move into said galvanized layer;

said process including also a step of adding aluminum in a slight amount into said molten zinc bath (hereinafter referred to as the "prior art (1)").

(b) A process for manufacturing an alloy-treated hot-dip galvanized steel sheet, disclosed in Japanese Patent provisional Publication No. 21,940/75 dated Mar. 8, 1975, which comprises:

Passing a steel sheet through a molten zinc bath added with at least 0.05 wt.% aluminum to prepare a hot-dip galvanized steel sheet; and then, converting the galvanized layer of said galvanized steel sheet into a Zn-Fe (2–60%) alloy layer by heating said galvanized steel sheet at a temperature of from 400° to 480° C. in a batch annealing furnace (hereinafter referred to as the "prior art (2)").

(2) Process based on electro-galvanizing:

(a) A process for manufacturing an electro-galvanized steel sheet excellent in corrosion resistance and paintability, disclosed in Japanese Patent Provisional Publication No. 42,343/72 dated Dec. 15, 1972, which comprises:

subjecting a cold-rolled steel sheet to a conventional electro-galvanizing treatment to prepare an electro-galvanized steel sheet having a galvanized layer with a thickness of from 0.5 to 10 μm per side; then, converting said galvanized layer into a Zn-Fe (2–9%) alloy layer by heating said electro-galvanized steel sheet at a temperature of from 350° to 800° C. for a period of time of from 1 to 30 seconds; and then, rapidly cooling said electro-galvanized steel sheet (hereinafter referred to as the "prior art (3)").

(b) A process for manufacturing an electro-galvanized steel sheet for coating, disclosed in Japanese Patent Provisional Publication No. 154,126/75 dated Dec. 11, 1975, which comprises:

subjecting a steel sheet to a conventional electro-galvanizing treatment to prepare an electro-galvanized steel sheet having a galvanized layer with a thickness of from 1 to 3 μm per side; then, converting said galvanized layer into a Zn-Fe (6–9%) alloy layer by heating said electro-galvanized steel sheet to a temperature of from 450° to 600° C. at a heating rate of from 2° to 60° C./second in a reducing or neutral atmosphere; and then, rapidly cooling said electro-galvanized steel sheet (hereinafter referred to as the "prior art (4)").

(c) A process for manufacturing a one-side electro-galvanized steel sheet, disclosed in Japanese Patent Provisional Publication No. 17,534/78 dated Feb. 17, 1978, which comprises:

subjecting a cold-rolled steel sheet to a conventional one-side electro-galvanizing treatment to prepare a one-side electro-galvanized steel sheet having a galvanized layer in an amount of from 10 to 40 g/m$^2$ per side; then, after coiling said electro-galvanized steel sheet into an open coil, converting said galvanized layer into a Zn-Fe (6.5–25%) alloy layer by heating said electro-galvanized steel sheet in the state of an open coil at a temperature of from 250° to 375° C. for a period of time of from 0.1 to 20 hours in a non-oxidizing or weak reducing atmosphere; and then, subjecting said electro-galvanized steel sheet to a skinpass rolling at a reduction ratio of about 1% (hereinafter referred to as the "prior art (5)").

Conventional alloy-treated galvanized steel sheets manufactured by the above-mentioned prior arts (1) to (5), of which the entire galvanized layer is converted into a Zn-Fe alloy layer in all cases, have certainly a post-coating corrosion resistance superior to that of a cold-rolled steel sheet and an ordinary galvanized steel sheet not applied with an alloying treatment, but have the following problems:

(1) In a conventional alloy-treated galvanized steel sheet, which contains Fe in the galvanized layer thereof, bare corrosion resistance of the galvanized layer, i.e., corrosion resistance of the galvanized layer itself is inferior to that of an ordinary galvanized steel sheet not applied with an alloying treatment. More particularly, corrosion of a coated galvanized steel sheet starts from a flaw of the coated film, a portion without coated film because of the insufficient adhesion of the coated film and a portion where a film of a required thickness has not been ensured. An inferior bare corrosion resistance of the galvanized layer causes rapid progress of corrosion from the above-mentioned portions with defective coating, thus seriously impairing corrosion resistance of the galvanized steel sheet as a whole.

(2) A galvanized steel sheet is usually subjected to various formings such as bending and drawing to meet the final use. To have an excellent formability is therefore one of the important properties indispensable for a galvanized steel sheet. However, because the entire galvanized layer is converted into a hard and brittle Zn-Fe alloy layer in the conventional alloy-treated galvanized steel sheet, formability is seriously decreased according as the galvanized layer grows thicker, thus making it impossible for the conventional alloy-treated galvanized steel sheet to bear a severe forming. On the other hand, if the galvanized layer is made thinner to prevent formability from decreasing, corrosion resistance is decreased. For these reasons, the thickness of the galvanized layer of the conventional alloy-treated galvanized steel sheet is inevitably limited within a certain range.

(3) In the hot-dip galvanizing process, as in the prior arts (1) and (2), not only it is difficult to apply a thin galvanized layer and a one-side galvanized layer, but also the thickness distribution of the galvanized layer tends to be non-uniform. Furthermore, in the conventional alloy-treated galvanized steel sheet manufactured by the hot-dip galvanizing process, the high temperature of the molten zinc bath (about 460° C.) causes deterioration of the properties such as ductility and deep-drawability of the steel sheet, thus restricting the uses within a limited range.

(4) The electro-galvanizing process, as in the prior arts (3) to (5), requires a high installation cost because of the necessity to specially install a heating equipment with an adjusted atmosphere in or outside the line. As in the prior art (5), furthermore, a heating step applied after coiling the electro-galvanized steel sheet into an open coil makes the process more complicated, thus leading to a higher manufacturing cost.

As compared with the conventional alloy-treated galvanized steel sheet manufactured in compliance with any of the prior arts (1) to (5), the ordinary galvanized steel sheet not applied with an alloying treatment, having a higher formability, is inferior in post-coating corrosion resistance and is not therefore suitable for external, underside and closed structures of an automobile.

Post-coating corrosion resistance of a galvanized steel sheet is generally considered to be determined by respective corrosion resistance of the galvanized layer, the chemical film or the painted film and corrosion resistance of the interface between the galvanized layer and the chemical film or the painted film. Particularly, in a galvanized steel sheet for coating, bare corrosion resistance of the galvanized layer and corrosion resistance of the interface between the galvanized layer and the chemical film or the painted film are very important for ensuring a satisfactory post-coating corrosion resistance.

However, the conventional galvanized steel sheet applied with an alloying treatment for the purpose of improving post-coating corrosion resistance, while being excellent in corrosion resistance of the interface between the galvanized layer and the chemical film or the painted film, is inferior in bare corrosion resistance of the galvanized layer and formability. The ordinary galvanized steel sheet, on the contrary, while being excellent in bare corrosion resistance of the galvanized layer and formability, is very low in corrosion resistance of the interface between the galvanized layer and the chemical film or the painted film.

Under such circumstances, there is an demand for the development of an electro-galvanized steel sheet for coating which is excellent not only both in bare corrosion resistance of the galvanized layer and corrosion resistance of the interface between the galvanized layer and the chemical film or the painted film, but also in formability, but an electro-galvanized steel sheet provided with all these properties is not as yet proposed.

SUMMARY OF THE INVENTION

An object of the present invention is therefore to provide an electro-galvanized steel sheet for coating excellent not only in bare corrosion resistance of the galvanized layer and corrosion resistance of the interface between the galvanized layer and the chemical film or the painted film but also in formability.

In accordance with one of the features of the present invention, there is porvided an electro-galvanized steel sheet excellent in bare corrosion resistance, corrosion resistance after coating and formability, characterized by comprising:

a steel sheet;

a first electro-galvanized layer, as a lower layer, in an amount of from 5 to 120 g/m$^2$ per side, formed on at least one surface of said steel sheet, selected from the group consisting of:

(A) an electro-galvanized layer consisting essentially of zinc, and (B) a compound electro-galvanized layer consisting essentially of zinc, cobalt, and at least one of chromium, indium and zirconium; and, a second electro-galvanized layer, as an upper layer, in an amount of from 0.2 to 10 g/m$^2$ per side, formed on said first electro-galvanized layer, said second electro-galvanized layer consisting essentially of zinc and from 1 to 60 wt.% iron.

DETAILED DESCRIPTION OF PREFERRED EMBODIMENTS

In view of the relative merits and demerits of the conventional alloy-treated galvanized steel sheet and the ordinary galvanized steel sheet not applied with an alloying treatment as mentioned above, we carried out extensive studies with a view to obtaining an electro-galvanized steel sheet for coating excellent not only in bare corrosion resistance of the galvanized layer and corrosion resistance after coating, i.e., corrosion resistance of the interface between the galvanized layer and the chemical film or the painted film, but also in formability, which is adapted to serve particularly for external, underside and closed structures of an automobile. As a result, we developed an electro-galvanized steel sheet for coating satisfactorily provided with the above-mentioned properties.

The electro-galvanized steel sheet for coating of the present invention is characterized by comprising:

a steel sheet;

a first electro-galvanized layer, as a lower layer, in an amount of from 5 to 120 g/m$^2$ per side, formed on at least one surface of said steel sheet, selected from the group consisting of:

(A) an electro-galvanized layer consisting essentially of zinc, and (B) a compound electro-galvanized layer consisting essentially of zinc, cobalt, and at least one of chromium, indium and zirconium; and, a second electro-galvanized layer, as an upper layer, in an amount of from 0.2 to 10 g/m$^2$ per side, formed on said first electro-galvanized layer, said second electro-galvanized layer consisting essentially of zinc and from 1 to 60 wt.% iron.

The first electro-galvanized layer, as the lower layer, of the electro-galvanized steel sheet of the present invention comprises any of an electro-galvanized layer consisting essentially of zinc (hereinafter referred to as the "lower pure-zinc galvanized layer") and a compound electro-galvanized layer consisting essentially of zinc, cobalt, and at least one of chromium, indium, and zirconium (hereinafter referred to as the "lower compound galvanized layer").

The galvanizing bath used for forming the lower pure-zinc galvanized layer on at least one surface of the steel sheet may be a conventional acidic galvanizing bath. More specifically, zinc sulfate ($ZnSO_4.7H_2O$) or zinc chloride ($ZnCl_2$) is used as a zinc source, sodium sulfate ($Na_2SO_4$) or ammonium chloride ($NH_4Cl$) is used as a conductive assistant, and sodium acetate ($CH_3COONa$) or sodium succinate ($(CH_2COONa)_2.7H_2O$) is used as a pH buffer. For example, an acidic galvanizing bath, having a pH value of from 1 to 4, containing $ZnSO_4.7H_2O$ in an amount of about 100 g/l as converted into zinc as the zinc source, about 50 g/l of $Na_2SO_4$ as the conductive assistant and about 15 g/l of $CH_3COONa$ as the pH buffer can be directly used as the galvanizing bath for forming a lower pure-zinc galvanizing layer. The electro-galvanizing conditions for forming the lower pure-zinc galvanized layer may be conventional conditions with no modification. For example, it suffices to subject the steel sheet to an electro-galvanizing treatment at a bath temperature of from 40° to 60° C., a current density of from 10 to 40 A/dm$^2$, and an energizing time of from 4 to 350 seconds.

The galvanizing bath used for forming the lower compound galvanized layer on at least one surface of the steel sheet may be a galvanizing bath prepared, with an acidic galvanizing bath having the same chemical composition as the above-mentioned conventional pure-zinc galvanizing bath as the base, by adding from 0.05 to 10 g/l of cobalt (Co), and at least one of from 0.05 to 0.5 g/l of hexavalent chromium ($Cr^{6+}$), from 0.05 to 0.7 g/l of trivalent chromium ($Cr^{3+}$), from 0.01 to 3 g/l of indium (In), and from 0.1 to 2.5 g/l of zirconium (Zr). When adding $Cr^{6+}$ and $Cr^{3+}$ at the same time, the total amount of addition should be within the range of from 0.05 to 0.7 g/l, and the amount of added $Cr^{6+}$ should be up to 0.05 g/l.

It is known that addition of Co to a pure-zinc galvanizing bath improves bare corrosion resistance of the formed galvanized layer, and addition of at least one of $Cr^{6+}$, $Cr^{3+}$, In and Zr further improves bare corrosion resistance of the formed galvanized layer under the multiplier effect thereof with Co. However, when the amounts of addition of these constituents are under the above-mentioned respective ranges, a desired effect cannot be obtained in the improvement of bare corrosion resistance of the galvanized layer. On the other hand, amounts of addition of these elements of over the above-mentioned respective ranges result in such inconveniences as blackening of the formed galvanized layer, production of precipitates in the galvanizing bath and occurrence of deposits on the electrode.

Cobalt sulfate, cobalt chloride or cobalt acetate is used as the Co source; chromium sulfate, chromium nitrate or chromium-ammonium sulfate is used as the $Cr^{3+}$ source; bichromic acid, chromic acid, an alkali or ammonium salt thereof is used as the $Cr^{6+}$ source; indium sulfate or indium chloride is used as the In source; and zirconium sulfate or zirconium chloride is used as the Zr source.

The electro-galvanizing conditions for forming the lower compound galvanized layer may be the same as the electro-galvanizing conditions for forming the lower pure-zinc galvanized layer.

The amount of the above-mentioned first electro-galvanized layer as the lower layer should be within the range of from 5 to 120 g/m$^2$ per side. This is because, with an amount of the first electro-galvanized layer of under 5 g/m$^2$ per side, a desired bare corrosion resistance cannot be obtained. With an amount of the first electro-galvanized layer of over 120 g/m$^2$ per side, on the other hand, bare corrosion resistance is further improved, whereas a higher manufacturing cost is required.

As described above, the first electro-galvanized layer, as the lower layer, of the electro-galvanized steel sheet of the present invention comprises either a pure-zinc galvanized layer or a compound galvanized layer consisting essentially of zinc, a small amount of cobalt, and small amounts of chromium, indium and/or zirconium. Therefore, the electro-galvanized steel sheet of the present invention having said first electro-galvanized layer has excellent bare corrosion resistance and formability well comparable with the ordinary galvanized steel sheet.

The second electro-galvanized layer, as the upper layer, of the electro-galvanized steel sheet of the present invention consists essentially of an alloy layer of zinc and iron (hereinafter referred to as the "Zn-Fe alloy layer").

The galvanizing bath used for forming the second electro-galvanized layer, as the upper layer, or the above-mentioned first electro-galvanized layer may be an acidic galvanizing bath prepared by replacing a portion of zinc sulfate ($ZnSO_4.7H_2O$) or zinc chloride ($ZnCl_2$) as the zinc source with iron sulfate ($FeSO_4.7H_2O$) or iron chloride ($FeCl_2$) so as to replace from 20 to 90 wt.%, more preferably from 60 to 90 wt. % of the amount of zinc in the aforementioned conventional pure-zinc galvanizing bath with iron. An amount of replacement of zinc in said acidic galvanizing bath with iron outside the above-mentioned range is not desirable because a Zn-Fe alloy layer containing Fe of a desired Fe as described later cannot be obtained.

The electro-galvanized conditions for forming the second electro-galvanized layer as the upper layer should preferably include a bath temperature of from 40° to 60° C., a pH value of from 1 to 4, a current density of from 10 to 40 A/dm$^2$, and an energizing time of from 0.2 to 42 seconds. This is because, it is impossible not only to obtain a second electro-galvanized layer, i.e., a Zn-Fe alloy layer, of a desired thickness as described later with a bath temperature, a pH value, a current density, and an energizing time outside the above-mentioned ranges, but also to obtain a uniform Zn-Fe alloy layer containing Fe of a desired ratio.

The amount of the second electro-galvanized layer as the upper layer should be within the range of from 0.2 to 10 g/m$^2$ per side. With an amount of the second electro-galvanized layer of under 0.2 g/m$^2$ per side, the second electro-galvanized layer as the upper layer cannot completely cover the first electro-galvanized layer as the lower layer. With an amount of the second electro-galvanized layer of under 0.2 g/m$^2$ per side, furthermore, during the chemical treatment applied to the electro-galvanized steel sheet in an electrolyte, most of the second electro-galvanized layer as the upper layer is dissolved into the electrolyte to expose the first electro-galvanized layer as the lower layer, thus rendering post-coating corrosion resistance thereof to almost the same order as that of the ordinary galvanized steel sheet and making it impossible to obtain the effect of improving post-coating corrosion resistance under the present invention. On the other hand, with an amount of the second electro-galvanized layer of over 10 g/m$^2$ per side, the second electro-galvanized layer comprising a hard and brittle Zn-Fe alloy layer grows excessively thicker, thus resulting not only in a lower formability but also in no marked improvement in post-coating corrosion resistance.

The amount of iron in the second electro-galvanized layer as the upper layer, i.e., in the Zn-Fe alloy layer, should be within the range of from 1 to 60 wt. %, more preferably from 5 to 35 wt. %. With an amount of iron in the Zn-Fe alloy layer of under 1 wt. %, the surface quality is almost the same as that of the ordinary galvanized steel sheet, thus making it impossible to obtain the effect of improving post-coating corrosion resistance under the present invention. On the other hand, with an amount of iron in the Zn-Fe alloy layer of over 60 wt. %, the surface quality becomes closer to that of the cold-rolled steel sheet, thus resulting in a lower bare corrosion resistance.

The second electro-galvanized layer, as the upper layer, of the electro-galvanized steel sheet of the present invention comprises a Zn-Fe alloy layer in a slight amount as described above. The electro-galvanized steel sheet of the present invention having said second electro-galvanized layer has therefore excellent post-coating corrosion resistance and formability well comparable with the cold-rolled steel sheet or the conventional alloy-treated galvanized steel sheet.

Now, the electro-galvanized steel sheet for coating of the present invention is described more in detail by means of an example.

EXAMPLE

A steel sheet was subjected to a first electro-galvanizing treatment under the following conditions:

(1) chemical composition of the acidic pure-zinc galvanizing bath used:

zinc sulfate ($ZnSO_4.7H_2O$): 500 g/l,
sodium sulfate ($Na_2SO_4$): 30 g/l
sodium acetate ($CH_3COON_a$): 15 g/l, (2) electro-galvanizing conditions:

pH value: from 2 to 4,
bath temperature: from 40° to 60° C.,
current density: from 10 to 40 A/dm$^2$,
energizing time: from 4 to 350 seconds, to form a first electro-galvanized layer as a lower layer in an amount as shown in Table 1 per side on the surface of said steel sheet.

Then, in an acidic galvanizing bath prepared by replacing a portion of zinc sulfate as a zinc source with iron sulfate as an iron source so as to replace from 20 to 90 wt. % of zinc contained in the acidic pure-zinc galvanizing bath shown in (1) above with iron, said steel sheet, on the surface of which said first electro-galvanized layer had been formed was subjected to a second electro-galvanizing treatment under the following conditions:

pH value: from 2 to 4,
bath temperature: from 40° to 60° C.,
current density: from 10 to 40 A/dm$^2$,
energizing time: from 0.2 to 42 seconds, to form a second electro-galvanized layer as an upper layer comprising a Zn-Fe alloy layer in an amount as shown in Table 1 per side on said first electro-galvanized layer.

Test specimens of the electro-galvanized steel sheet for coating of the present invention having a first electro-galvanized layer and a second electro-galvanized layer in amounts as shown in Table 1 per side (hereinafter referred to as the "test specimens of the present invention") Nos. 1 to 22 were thus prepared. The first electro-galvanized layers of the test specimens of the present invention Nos. 12 to 22 were formed under the electro-galvanizing conditions as shown in (2) above with the use of an acidic galvanizing bath prepared by adding 8 g/l of Co and 0.5 g/l of $Cr^{3+}$ to the acidic pure-zinc galvanizing bath shown in (1) above.

Then, bare corrosion resistance, post-coating corrosion resistance, formability and productivity were evaluated for the test specimens of the present invention Nos. 1 to 22. Bare corrosion resistance was evaluated on the basis of the occurrence of red rust on the surface of a test specimen after the lapse of 36 hours in the salt spray test specified in JIS (abbreviation of the "Japanese Industrial Standards") Z 2371. Post-coating corrosion resistance was evaluated on the basis of the occurrence of red rust on the surface of a test specimen after the lapse of 3,000 hours in the salt spray test specified in JIS Z 2371 on a coated test specimen obtained by forming a membrane type chemical film for automobile on the surface of the test specimen, and then forming a 20 μm thick painted film on said chemical film by means of an ordinary anion type electro-depositing process. Formability was evaluated on the basis of the results of a 90° bending test on a test specimen. Productivity was comprehensively evaluated as to the range of uses, relative difficulty of one-side galvanizing, operational easiness and productivity.

The results of these evaluations are also shown in Table 1. In Table 1, the mark "◎" indicates excellent; "o", satisfactory; "x", not satisfactory; and "xx", defective. The figures for the amount of Fe and the amount of galvanized layer in Table 1 indicate in all cases the amounts per side.

adding 8 g/l of Co and 0.5 g/l of $Cr^{3+}$ to a conventional acidic pure-zinc galvanizing bath.

The reference test specimens Nos. 6 to 17 are electro-galvanized steel sheets each having a first electro-galvanized layer as the lower layer and a second electro-galvanized layer as the upper layer in amounts as shown in Table 2 per side, as in the electro-galvanized steel sheet of the present invention. More particularly, the reference test specimens Nos. 6 to 11 are electro-galvanized steel sheets each having a first electro-galvanized layer as the lower layer and a second electro-galvanized layer as the upper layer, i.e., a Zn-Fe alloy layer, as in

TABLE 1

| Test specimens of the present invention | First galvanized layer | | | Second galvanized layer | | | Bare corrosion resistance | Post-coating corrosion resistance | Formability | Productivity |
|---|---|---|---|---|---|---|---|---|---|---|
| | Constituents | Amount of Fe (wt. %) | Amount of galvanized layer ($g/m^2$) | Constituents | Amount of Fe (wt. %) | Amount of galvanized layer ($g/m^2$) | | | | |
| 1 | Zn | — | 39 | Zn & Fe | 2 | 1 | o | ◎ | ◎ | ◎ |
| 2 | Zn | — | 39 | Zn & Fe | 10 | 1 | o | ◎ | ◎ | ◎ |
| 3 | Zn | — | 39 | Zn & Fe | 50 | 1 | o | ◎ | ◎ | ◎ |
| 4 | Zn | — | 38 | Zn & Fe | 2 | 2 | o | ◎ | ◎ | ◎ |
| 5 | Zn | — | 38 | Zn & Fe | 30 | 2 | o | ◎ | ◎ | ◎ |
| 6 | Zn | — | 38 | Zn & Fe | 50 | 2 | o | ◎ | ◎ | ◎ |
| 7 | Zn | — | 36 | Zn & Fe | 2 | 4 | o | ◎ | ◎ | ◎ |
| 8 | Zn | — | 36 | Zn & Fe | 30 | 4 | o | ◎ | ◎ | ◎ |
| 9 | Zn | — | 30 | Zn & Fe | 2 | 10 | o | ◎ | ◎ | ◎ |
| 10 | Zn | — | 30 | Zn & Fe | 10 | 10 | o | ◎ | ◎ | ◎ |
| 11 | Zn | — | 110 | Zn & Fe | 30 | 10 | ◎ | ◎ | ◎ | ◎ |
| 12 | Zn, Co & Cr | — | 39 | Zn & Fe | 2 | 1 | ◎ | ◎ | ◎ | ◎ |
| 13 | Zn, Co & Cr | — | 39 | Zn & Fe | 10 | 1 | ◎ | ◎ | ◎ | ◎ |
| 14 | Zn, Co & Cr | — | 39 | Zn & Fe | 30 | 1 | ◎ | ◎ | ◎ | ◎ |
| 15 | Zn, Co & Cr | — | 39 | Zn & Fe | 50 | 1 | ◎ | ◎ | ◎ | ◎ |
| 16 | Zn, Co & Cr | — | 38 | Zn & Fe | 2 | 2 | ◎ | ◎ | ◎ | ◎ |
| 17 | Zn, Co & Cr | — | 38 | Zn & Fe | 10 | 2 | ◎ | ◎ | ◎ | ◎ |
| 18 | Zn, Co & Cr | — | 38 | Zn & Fe | 30 | 2 | ◎ | ◎ | ◎ | ◎ |
| 19 | Zn, Co & Cr | — | 38 | Zn & Fe | 50 | 2 | ◎ | ◎ | ◎ | ◎ |
| 20 | Zn, Co & Cr | — | 30 | Zn & Fe | 2 | 10 | ◎ | ◎ | ◎ | ◎ |
| 21 | Zn, Co & Cr | — | 30 | Zn & Fe | 10 | 10 | ◎ | ◎ | ◎ | ◎ |
| 22 | Zn, Co & Cr | — | 30 | Zn & Fe | 30 | 10 | ◎ | ◎ | ◎ | ◎ |

Then, for comparison purposes, test specimens as shown in Table 2 of a cold-rolled steel sheet not applied with a galvanizing treatment, galvanized steel sheets with a single galvanized layer and galvanized steel sheets with two galvanized layers, outside the scope of the present invention (hereinafter referred to as the "reference test specimens") Nos. 1 to 17 were prepared.

The reference test specimen No. 1 is a cold-rolled steel sheet not applied with a galvanized treatment. The reference test specimens Nos. 2 to 5 are galvanized steel sheets each having a single galvanized layer in an amount as shown in Table 2 per side. More specifically, the reference test specimen No. 2 is an ordinary galvanized steel sheet; the reference test specimen No. 3 is a conventional alloy-treated electro-galvanized steel sheet obtained by heating an electro-galvanized steel sheet at a temperature of about 300° C. for about 3 hours, corresponding to the prior art (5) previously mentioned under the caption of the "BACKGROUND OF THE INVENTION"; the reference test specimen No. 4 is a conventional alloy-treated hot-dip galvanized steel sheet obtained by heating a hot-dip galvanized steel sheet, corresponding to the prior art (1) or (2) previously mentioned under the "BACKGROUND OF THE INVENTION"; and, the reference test specimen No. 5 is an electro-galvanized steel sheet having a single compound galvanized layer, obtained by subjecting a cold-rolled steel sheet to an electro-galvanizing treatment in an acidic galvanizing bath prepared by the electro-galvanized steel sheet of the present invention, but with the amount of said Zn-Fe alloy layer exceeding the scope of the present invention; and the reference test specimens Nos. 12 to 17 are electro-galvanized steel sheets each having a first electro-galvanized layer as the upper layer, i.e., a Zn-Fe alloy layer, as in the electro-galvanized steel sheet of the present invention, with the amount of said Zn-Fe alloy layer being within the scope of the present invention, but with the amount of iron in said Zn-Fe alloy layer being outside the scope of the present invention. The reference test specimens Nos. 6 to 8 and Nos. 15 to 17 are electro-galvanized steel sheets, of which the first electro-galvanized layer as the lower layer has been formed in a conventional acidic pure-zinc galvanizing bath; and the reference test specimens Nos. 9 to 14 are electro-galvanized steel sheets, of which the first electro-galvanized layer has been formed in an acidic galvanizing bath prepared by adding 8 g/l of Co and 0.5 g/l of $Cr^{3+}$ to the conventional acidic pure-zinc galvanizing bath.

Then, bare corrosion resistance, post-coating corrosion resistance, formability and productivity were evaluated on the reference test specimens Nos. 1 to 17 outside the scope of the present invention in the same manner as in the test specimens of the present invention Nos. 1 to 22.

The results of these evaluations are also shown in Table 2. In Table 2, the mark " ◎ " indicates excellent; "o", satisfactory; "x", not satisfactory; and "xx", defective. The figures for the amount of Fe and the amount of galvanized layer in Table 2 indicate in all cases the amount per side.

TABLE 2

| Reference test specimens | First galvanized layer: Constituents | First galvanized layer: Amount of Fe (wt. %) | First galvanized layer: Amount of galvanized layer ($g/m^2$) | Second galvanized layer: Constituents | Second galvanized layer: Amount of Fe (wt. %) | Second galvanized layer: Amount of galvanized layer ($g/m^2$) | Bare corrosion resistance | Post-coating corrosion resistance | Formability | Productivity |
|---|---|---|---|---|---|---|---|---|---|---|
| 1 | — | — | — | — | — | — | xx | xx | ◎ | ◎ |
| 2 | Zn | — | 40 | — | — | — | o | x | ◎ | ◎ |
| 3 | Zn & Fe | 10 | 40 | — | — | — | x | ◎ | xx | x |
| 4 | Zn & Fe | 13 | 45 | — | — | — | x | ◎ | xx | x |
| 5 | Zn, Co & Cr | — | 40 | — | — | — | ◎ | x | ◎ | ◎ |
| 6 | Zn | — | 5 | Zn & Fe | 2 | 35 | x | ◎ | xx | x |
| 7 | Zn | — | 5 | Zn & Fe | 10 | 35 | x | ◎ | xx | x |
| 8 | Zn | — | 5 | Zn & Fe | 50 | 35 | x | ◎ | xx | x |
| 9 | Zn, Co & Cr | — | 5 | Zn & Fe | 2 | 35 | x | ◎ | xx | x |
| 10 | Zn, Co & Cr | — | 5 | Zn & Fe | 10 | 35 | x | ◎ | xx | x |
| 11 | Zn, Co & Cr | — | 5 | Zn & Fe | 50 | 35 | x | ◎ | xx | x |
| 12 | Zn, Co & Cr | — | 38 | Zn & Fe | 0.5 | 2 | o | x | ◎ | ◎ |
| 13 | Zn, Co & Cr | — | 38 | Zn & Fe | 80 | 2 | xx | xx | ◎ | ◎ |
| 14 | Zn, Co & Cr | — | 30 | Zn & Fe | 0.5 | 10 | o | x | ◎ | ◎ |
| 15 | Zn | — | 39 | Zn & Fe | 0.5 | 1 | o | x | ◎ | ◎ |
| 16 | Zn | — | 32 | Zn & Fe | 80 | 8 | xx | xx | ◎ | ◎ |
| 17 | Zn | — | 30 | Zn & Fe | 0.5 | 10 | o | x | ◎ | ◎ |

As is evident from the comparison of Tables 1 and 2, all of the reference test specimens Nos. 1 to 17 outside the scope of the present invention shown in Table 2 are inferior in one or more of bare corrosion resistance, post-coating corrosion resistance, formability and productivity. In contrast, the test specimens of the present invention Nos. 1 to 22 shown in Table 1 provided with the first electro-galvanized layer as the lower layer in an appropriate amount excellent in bare corrosion resistance and formability, and the second electro-galvanized layer, i.e., the Zn-Fe alloy layer, as the upper layer, in an appropriate amount excellent in post-coating corrosion resistance, are excellent in bare corrosion resistance, post-coating corrosion resistance and formability as well as in productivity. Especially, the test specimens of the present invention Nos. 12 to 22 with the first electro-galvanized layer comprising the compound galvanized layer of zinc, cobalt and chromium are more excellent in bare corrosion resistance as compared with the test specimens of the present invention Nos. 1 to 11 with the first electro-galvanized layer comprising the pure-zinc galvanized layer.

The electro-galvanized steel sheet for coating of the present invention is, as described above in detail, excellent in bare corrosion resistance and corrosion resistance after coating, having a first electro-galvanized layer as the lower layer in an appropriate amount excellent in bare corrosion resistance and formability and a second electro-galvanized layer as the upper layer, i.e., a Zn-Fe alloy layer, in an appropriate amount excellent in corrosion resistance after coating. In the present invention, furthermore, the second electro-galvanized layer comprising the Zn-Fe alloy layer is formed on the electro-galvanized layer as the lower layer through a conventional electro-galvanizing treatment in an acidic galvanizing bath added with iron, without converting the entire galvanizing layer of the galvanized steel sheet into a Zn-Fe alloy layer by heating in a specially installed heating equipment as in the manufacture of the conventional alloy-treated galvanized steel sheet. According to the present invention, therefore, it is possible not only to manufacture a high-quality electro-galvanized steel sheet, having uniform galvanized layers in a small amount, and having a wide range of uses, at low installation and running costs, but also to easily apply one-side galvanizing, thus providing many industrially useful effects.

What is claimed is:

1. An electro-galvanized steel sheet excellent in bare corrosion resistance, corrosion resistance after coating and formability, characterized by comprising:

a steel sheet;

a first electro-galvanized layer, as a lower layer, in an amount of from 5 to 120 $g/m^2$ per side, formed on at least one surface of said steel sheet, selected from the group consisting of:

(A) an electro-galvanized layer consisting essentially of zinc and (B) a compound electro-galvanized layer consisting essentially of zinc, cobalt, and at least one of chromium, indium and zirconium; and, a second electro-galvanized layer, as an upper layer, in an amount of from 0.2 to 10 $g/m^2$ per side, formed on said first electro-galvanized layer, said second electro-galvanized layer consisting essentially of zinc and from 1 to 60 wt. % iron.

2. The electro-galvanized steel sheet as claimed in claim 1, wherein said second electro-galvanized layer consists essentially of an alloy layer of zinc and from 5 to 35 wt. % iron.

* * * * *